United States Patent [19]

Parrott

[11] Patent Number: 4,871,036

[45] Date of Patent: Oct. 3, 1989

[54] COMPLIANT ROTARY POWERED TOOL

[76] Inventor: Gary A. Parrott, NE. 81 Gladwin Rd., Belfair, Wash. 98528

[21] Appl. No.: 934,471

[22] Filed: Nov. 24, 1986

[51] Int. Cl.[4] ..... F21B 3/00

[52] U.S. Cl. ..... 173/163; 173/DIG. 1; 173/171

[58] Field of Search ..... 173/12, 163, DIG. 1, 173/171, 38

[56] References Cited

U.S. PATENT DOCUMENTS

| | | | |
|---|---|---|---|
| 2,880,966 | 4/1959 | Blount | 173/DIG. 1 |
| 3,468,385 | 9/1969 | Penza | 173/DIG. 1 |
| 4,526,239 | 7/1985 | Kaneda et al. | 173/DIG. 1 |

*Primary Examiner*—Frank T. Yost
*Assistant Examiner*—Willmon Fridie, Jr.
*Attorney, Agent, or Firm*—Charles C. Logan, II

[57] ABSTRACT

A compliant rotary powered tool that has been designed with the ability to be gripped by a mechanical arm yet which allows the power tool to be operated against a three dimensional surface as effectively as if operated in the hands of a human operator. To allow accurate and sensitive control of the tool without requiring a mechanical arm beyond the capabilities of the present state of the art, a degree of compliance is designed into the tool itself. The structure which produces the compliant nature of the tool allows the tool itself to maintain an appropriate predetermined contact force between the tool and the work surface regardless of imprecise control of the mechanical arm. The structure which produces this compliance also compensates for lack of touch and feel in the mechanical arm and allows the tool to follow a three dimensional shape while maintaining a constant pressure of the operating surface of the tool against the work surface.

19 Claims, 3 Drawing Sheets

COMPLIANT ROTARY POWERED TOOL

BACKGROUND OF THE INVENTION

The invention relates to a tool and more specifically to a compliant rotary powered tool that is gripped in the mechanical arms of a machine.

One of the applications for which the novel compliant rotary powered tool has been designed relates to offshore oil production platforms. These platforms require continual maintenance and inspection of their tubular structures that are anchored at water depths down at 1100 feet. At the junctions of these tubular structures, they form nodes of varying complexity.

The action of swells and ocean currents subject bracings to stress and strain resulting in metal fatigue and electrolysis results in corrosion of these welded joints. Therefore, it is important to make regular inspections to determine the condition of every weld in these junctions.

Present day inspection techniques require, first of all, fine cleaning to remove marine growth and oxides covering the welds. Inspection takes place after the bare metal of the welds is made visible. Divers routinely carry out this work using water jets and rotary brushes, but diving hazards and expenses increase rapidly with increasing water depths. To replace divers, there exist removably controlled mechanical means of cleaning nodes.

Up to now, they haven×t been very effective. Traditional manipulator arms are in fact, inappropriate for this type of cleaning since they lack the sense of feel or touch necessary for the effective control of standard driver tools. Because conventional remotely controlled manipulators are incapable of finely responding to small variations of force, they are incapable of maintaining appropriate contact force between a tool and a work surface. For the same reason, they are also incapable of accurately tracing a complex curve such as is found, for example, at the junction of a platform leg and a bracing member.

The prior art has not been able to produce a structure which would allow compact mechanical arms to be given feel or touch abilities such as humans have. The mechanical arms have merely been able to advance the power tools and their operating structures against the surface to be worked upon but oftentimes the force applied by the arm is either excessive or insufficient to accomplish the results desired of the power tools.

One example of apparatus that has been designed for cleaning weldments on offshore platforms is illustrated in U.S. Pat. No. 4,502,407. Millions of dollars have been spent on the research and development of this device yet it remains essentially ineffective due to the lack of a compliant rotary powered tool and the inability of its mechanical arms to apply a standard non-compliant tool effectively against a surface to be cleaned.

It is an object of the invention to provide a novel compliant rotary powered tool that can be utilized to clean weldments on offshore platforms.

It is also an object of the invention to provide a novel compliant rotary powered tool that can be carried by remotely operated vehicles (ROV's).

It is another object of the invention to provide a novel compliant rotary powered tool that allows undersea cleaning of weldments of offshore platforms to be done as effectively in the hands of mechanical arms as it would be done by human divers.

It is a further object of the invention to provide a novel compliant rotary powered tool that is economical to manufacture, market and maintain.

SUMMARY OF THE INVENTION

Applicant's novel compliant rotary powered tool incorporates unique structure that allows the power tool's operating surface to be brought into contact with a surface to be operated on by a mechanical arm, yet with a compliant action which maintains an appropriate preset contact force between the tool's operating surface and the work surface. Such action replaces the human sense of touch or feel necessary for the effective application of standard rotary powered hand tools. An essential component of this structure is an elongated arm assembly that has a driveshaft journaled in its rearward end. The mechanical arm grasps the tool by a frame member which is also journaled coaxially with the drive shaft. When the tool is so grasped, the forward end of the arm assembly is free to pivot about the longitudinal axis of the driveshaft and the driveshaft is free to rotate within the frame member journal and the arm assembly journal. A driven shaft is journaled in the forward end of the arm assembly. A sprocket gear having a radius $R_1$ is mounted on the driveshaft and a sprocket gear having a radius $R_2$ is mounted on the sprocket gear mounted on the driven shaft. A chain transmits the rotational motion of the driveshaft to the driven shaft. A hydraulic motor would be generally utilized to power the driveshaft of the rotary powered tool. The body of the motor would be affixed to the frame member in one version of the tool and to the arm assembly in another version of the tool.

The sprocket gear on the driveshaft would have a radius greater than the radius of the sprocket gear on the driven shaft. In operation the viscous drag from the surrounding water exerts a braking force on the rotating brush. This causes one cord of the chain to be tighter than the other depending upon the direction of rotation. Because the arm assembly is journaled co-axially with the driveshaft and because the chain is pulling from a point above (or below) the axis of the arm assembly, a resultant moment is created with moves the arm up or down, again depending upon the direction of rotation. This moment can be increased by (1) increasing hydraulic flow to the motor, (2) increasing the chain angle, (3) decreasing the arm assembly length, or (4) adding more viscous drag to the wheel.

One advantage of the arrangement described is that, without additional controls, the arm can be lifted by reversing the motor, and the brush can then be eased down onto the weld by gradually speeding it up in forward. As rpm is increased, so is the "bite" of the wheel against the surface. It is impossible to stall out the brush because the moment force is self-regulating. If bite becomes excessive, the wheel will slow, thereby reducing viscous drag.

The arm assembly would be buoyed to neutral with rigid, captive air tanks or syntatic foam. Gravity has no effect on the tool's operation. It will clean the underside of a surface as easily as it will clean the top side. The moment created by harnessing the viscous drag gives the tool a sophisticated form of compliance unavailable in state of the art subsea robotics. It makes practical the use of simple shape-following, feel-dependent tools, by mechanical arms.

The compliant rotary powered tool also has a spring-loaded wrist just behind its driveshaft journal. It gives a rudimentary compliance in a second axis. This makes the tool even more forgiving of manipulator error or imprecision. In fact, the manipulator can drag the tool sideways across a weld and the wrist will flex and allow the brush to follow in the correct attitude.

Although most of the discussion to this point has related to the rotary powered tool being used for cleaning weldments, it would have other applications as well. By replacing the brush with an abrasive cutoff wheel, the compliance feature would provide regulated feed for metallic cutoff operations in any attitude. By going through a set of miter gears at the free end of the arm, rotational direction could also be changed 90 degrees. This would permit the addition of a chuck for use with a drill bit (again self-feeding), a broach cutter, an end brush or cup brush. With a compliant, shape-following apparatus, such as this, rough welding and oxy-arc cutting could be possible. In this case, the brush in the primary embodiment of the rotary powered tool would be replaced by a structure for generating drag such as an Astroturf disc. The welding or burning apparatus would be affixed to the free end of the arm.

Applicant's invention could also be used in an air atmosphere by adding a blower fan to the arm for drag. This simple accessory would be run directly or indirectly off the brush wheel to create drag. It would be similar to the same mechanism used on indoor trainers by bicylists.

DESCRIPTION OF THE PREFERRED EMBODIMENT

Applicant's novel compliant rotary powered tool will be described by referring to FIGS. 1–7 of the drawings. The compliant rotary powered tool is generally designated numeral 10.

Figure 1:
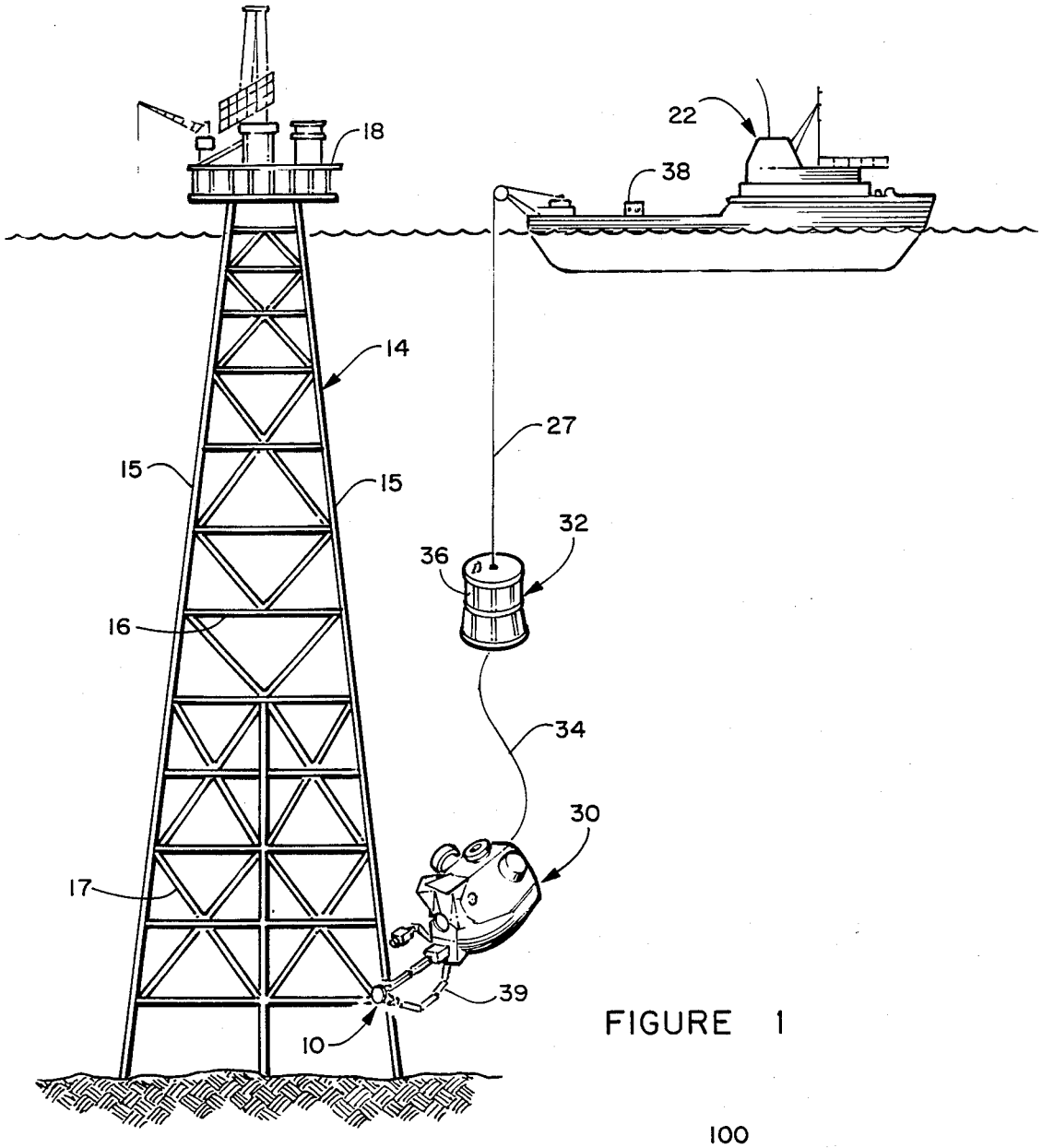
FIG. 1 is a side elevation view illustrating applicant's novel compliant rotary powered tool attached to the arms of a remotely operated vehicle (ROV)

In FIG. 1 rotary powered tool 10 is illustrated in one of the major enviroments for which it has been designed. Offshore platform 14 has a plurality of slanting legs 15, cross-bracing members 16, and diagonal braces 17. Platform 14 is also provided with a deck 18 upon which is mounted various pieces of equipment that are used in the production of oil and gas wells. A service boat 22 supports the R O V.

The remotely controled underwater vehicle 30 is connected to its protective lowering launch cage 32 by means of a tether 34. A remotely operated reel or drum 36 is mounted in the upper portion of cage 32 and is adapted to be remotely operated through cable 27 from the service boat 22 to reel in or let out the tether 34 as required. Since vehicle launching cages 32 are well known in the art and form no part of this invention they will not be further discussed here.

Hoisting cable 27 is a load-suporting cable as well as being equiped to transmit power from the vessel 22 to the vehicle 30, and to pass signals up and down the cable to operate the equipment carried by the vehicle 30 as well as to operate the tether reel 36 carried by the cage 32. In a like manner, the tether cable 34 is both a power- and signal- transmitting cable which preferrably is of neutral buoyancy to reduce drag on the vehicle as it moves through the water. Power to the vehicle 30 and signals to and from the vehicle are conducted through the cables 27 and 34. A controler means 38 is located on the vessel 22 for controlling the functions of the vehicle 30 as well as its cage 32. The controller 38 is also equiped with a television screen for viewing the area in the vicinity of the vehicle 30, and remote controls for controlling the vehicle's mechanical arm.

Compliant rotary powered tool 10 would be detachably held by a mechanical arm 39 of the underwater vehicle 30. The specific structure of the compliant rotary powered tool is best described by referring to FIGS. 2 and 3. It has an arm assembly 42 having a driveshaft 44 journaled in its one end and a driven shaft 46 journaled in its other end. A drive sprocket 45 is mounted on driveshaft 44 and a sprocket gear 47 is mounted on driven shaft 46. A closed loop chain 48 passes around the respective sprocket gears. Sprocket gear 45 has radius $R_1$ that is larger than radius $R_2$ of sprocket gear 47. The arm assembly 42 has structure which allows for it to be telescopically shortened in order to change the chain 48 and then lengthened in order to stretch the chain tightly.

A wire brush or abrasive wheel 50 is mounted on driven shaft 46 and it produces a viscous drag when it is rotated. The manner in which this causes the arm assembly 42 to pivot around shaft 44 has been described previously in the summary of the invention.

A hydraulic motor 52 is attached to bracket 54 which in turn is attached to frame member 56 which is journaled on shaft 44. A drive shaft 57 extends from hydraulic motor 52 and it drives sprocket gear 58. A chain 59 passing around sprocket gear 58 and sprocket gear 60 transmits the rotational motion of drive shaft 57 to drive shaft 44. Hydraulic motor 52 has hydraulic connections 61 and 62 at its one side and by reversing the flow of the hydraulic fluid into the motor, the direction of rotation of the wire brush or abrasive wheel 50 can be changed.

A grip 70 for the mechanical arm 39 of remotely operated vehicle 30 is attached by torsion spring 72 to sleeve 74 which is in turn mounted on a brakcet 76 that is secured to frame 54. This structure allows the grip 70 to function in the manner of a wrist which can be flexed to give lateral compliance to the rotary powered tool.

Figure 4:
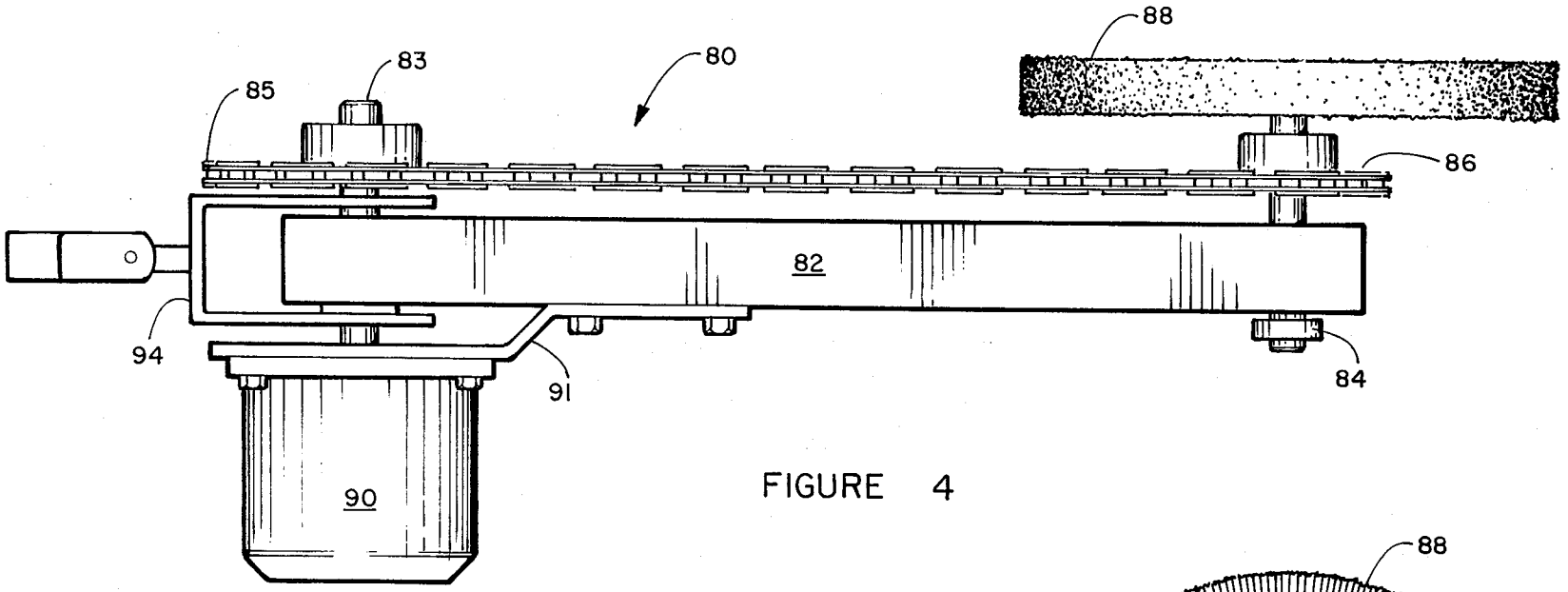
FIG. 4 is a top plan view of an alternative compliant rotary powered tool.
Figure 5:
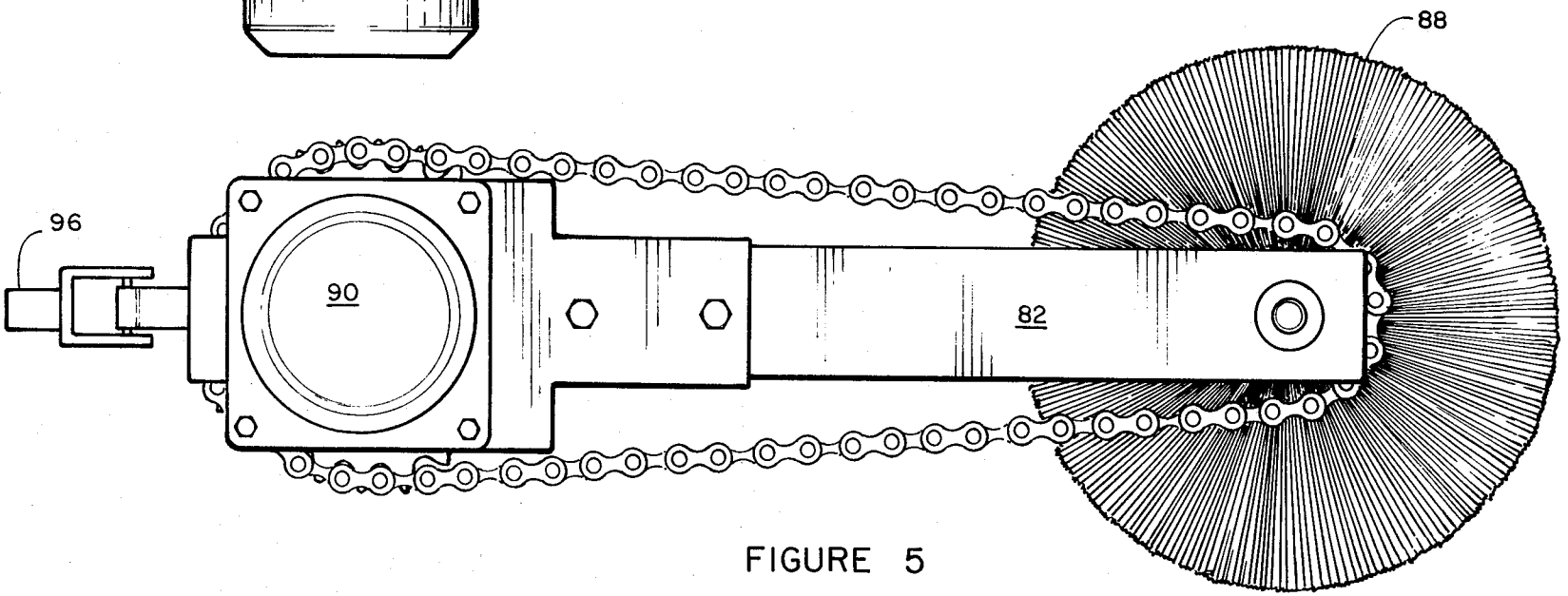
FIG. 5 is a side elevation view of the alternative compliant rotary powered tool.

An alternative embodiment of the compliant rotary powered tool is illustrated in FIGS. 4 and 5 and is generally designated numeral 80. It has an elongated arm assembly 82 having a driveshaft 83 journaled in its one end and a driven shaft 84 journaled in its other end. Sprocket gear 85 is mounted on drive shaft 83 and sprocket gear 86 is mounted on driven shaft 84. A wire brush or abrasive wheel 88 is mounted on driven shaft 84 and its rotational movement produces a viscous drag essential to the operation of applicant's device. A hydraulic motor 90 is attached by bracket 91 to arm assembly 82. The shaft extending from hydraulic motor 90 is driveshaft 83. A frame member 94 has bi-furcated arms that are journaled on driveshaft 83. A manipulator grip 96 is flexibly attached to frame member 94. This flexible wrist is spring loaded.

In this alternative embodiment, the counter-torque of the motor 90 is transferred by bracket 91 to the arm assembly 82. This counter-torque produces a moment in arm assembly 82 about the journal in its rearward end. This moment force the brush or wheel 88 against the work surface. The angle of chain pull will resist this force somewhat, but the resultant moment will be in favor of the moment produced by the counter-torque. The opposing force can be completely eliminated by making drive sprocket 85 equal to or smaller than driven sprocket 86.

Figure 6:
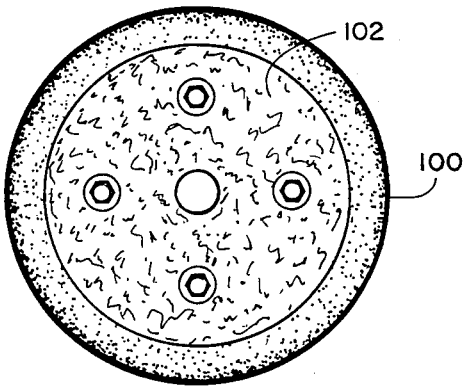
FIG. 6 is a top plan view of an abrasive cuttoff wheel to be used with the compliant rotary powered tool.
Figure 7:
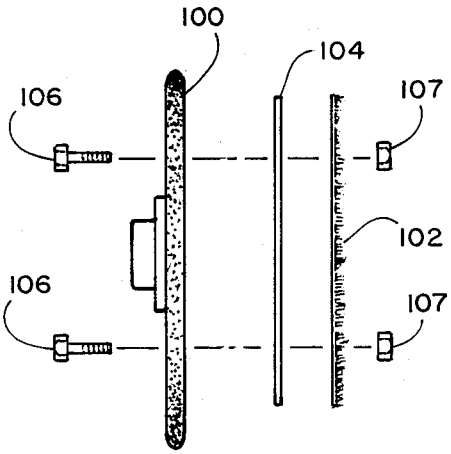
FIG. 7 is an exploded side elevation view of the abrasive cuttoff wheel.
Figure 2:
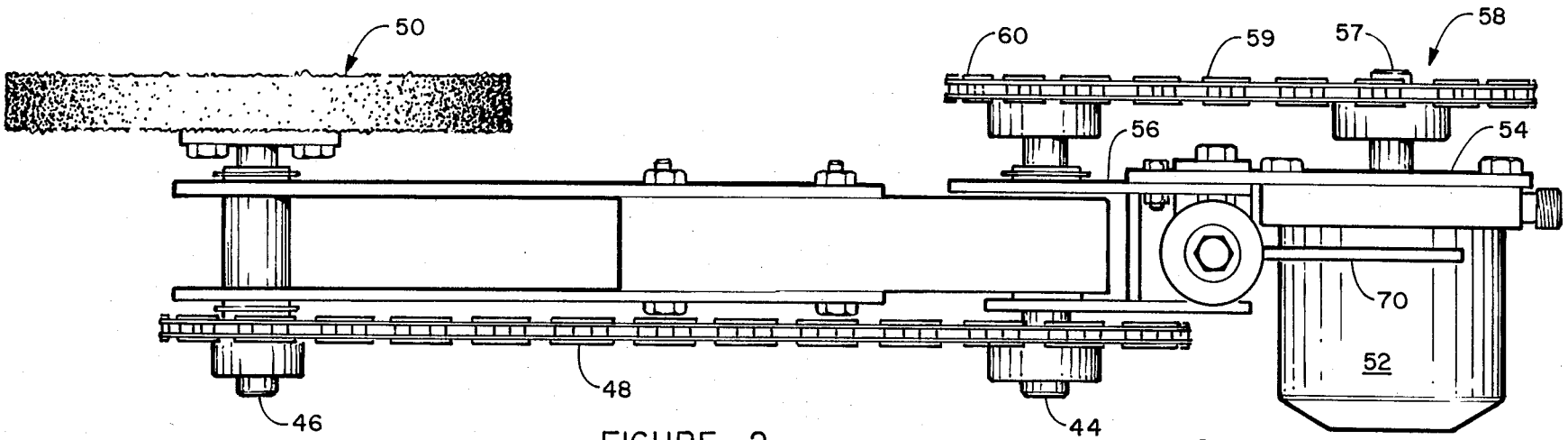
FIG. 2 is a top plan view of the novel compliant rotary powered tool.
Figure 3:
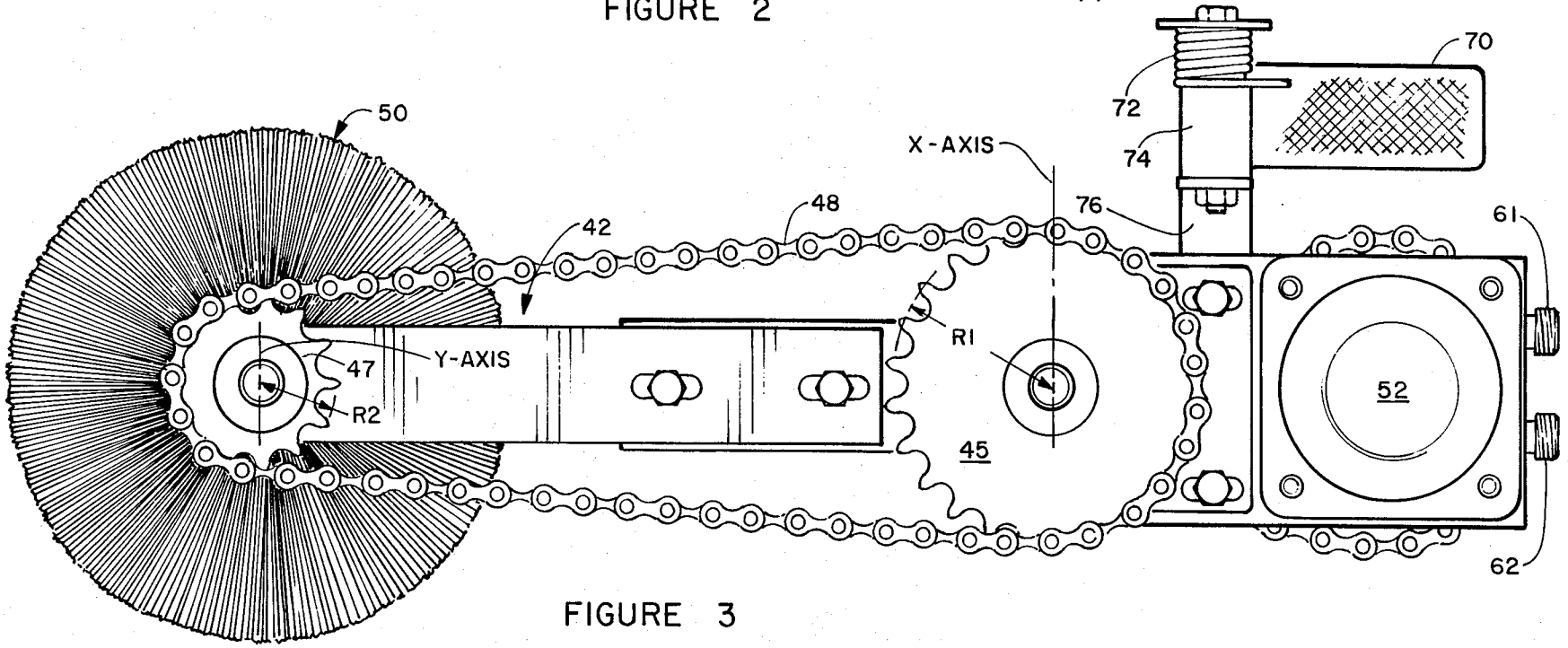
FIG. 3 is a side elevation view of the novel compliant rotary powered tool.

In FIGS. 6 and 7 an abrasive cuttoff wheel 100 is illustrated and this would be attached to driven shaft in place of the wire brush. Since this would need additional viscous drag to allow the compliant rotary powered tool to operate properly, a disc of Astroturf 102 could be attached by contact cement to an aluminum disc 104. This would then be bolted to abrasive cutoff wheel 100 by bolts 106 and nuts 107.

What is claimed is:

1. A compliant rotary tool comprising:

an elongated arm assembly having a forward end and a rearward end;

a driveshaft journaled in the rearward end of said arm assembly so that said arm assembly can pivot around said driveshaft, said driveshaft having a longitudinally extending axis;

a driven shaft journaled in the forward end of said arm assembly, said driven shaft having a longitudinally extending axis;

first drive means rigidly mounted on said driveshaft having a radius $R_1$ as measured from said longitudinal axis of said driveshaft, second drive means rigidly mounted on said driven shaft having a radius $R_2$ as measured from the longitudinal axis of said driven shaft, $R_1$ being greater than $R_2$ thereby creating an angle of pull;

closed loop means passing around the radius $R_1$ of said first drive means and around the radius $R_2$ of the second drive means for transmitting the rotational motion of said driveshaft to said driven shaft;

a frame member which is journaled on said driveshaft;

a motor for rotating said driveshaft and it is affixed to said frame member; and means for producing a drag on said driven shaft. drag.

2. A compliant rotary powered tool as recited in claim 1 wherein said motor means for rotating said driveshaft is a hydraulic motor.

3. A compliant rotary powered tool as recited in claim 1 wherein said elongated arm assembly has means for varying the length of said arm assembly.

4. A compliant rotary powered tool as recited in claim 1 wherein said first drive means is a sprocket gear having a radius $R_1$ and said second drive means is a sprocket gear having a radius $R_2$.

5. A compliant rotary powered tool as recited in claim 4 wherein said closed loop means is a chain passing around said sprocket gears.

6. A compliant rotary powered tool as recited in claim 1 wherein said means for producing a drag on said driven shaft is a wire brush.

7. A compliant rotary powered tool as recited in claim 1 wherein said power tool is immersed in a fluid medium.

8. A compliant rotary powered tool as recited in claim 1 further comprising a grip for said arm assembly.

9. A compliant rotary powered tool as recited in claim 8 wherein said grip is flexibly attached to the frame of said compliant rotary powered tool.

10. A compliant rotary powered tool comprising:

an elongated arm assembly having a forward end and a rearward end;

a driveshaft journaled in the rearward end of said arm assembly so that said arm assembly can pivot around said driveshaft;

a driven shaft journaled in the forward end of said arm assembly;

means for transmitting power from said driveshaft to said driven shaft;

a motor for rotating said driveshaft, said motor having a shaft that is coaxially affixed to said driveshaft, said motor having a frame member that is affixed to said arm assembly;

said frame member being journaled on said drive shaft; and means for producing a resultant moment which moves the forward end of said arm assembly either up or down.

11. A compliant rotary powered tool as recited in claim 10 wherein said means for producing a resultant moment is produced by a drag on said driveshaft.

12. A compliant rotary powered tool as recited in claim 10 wherein said means for producing a resultant moment is produced by a drag on said driveshaft.

13. A compliant rotary powered tool as recited in claim 10 wherein said means for producing a resultant moment is produced by a drag on said means for transmitting power from said driveshaft to said driven shaft.

14. A compliant rotary powered tool as recited in claim 10 wherein said motor means is a hydraulic motor.

15. A compliant rotary powered tool as recited in claim 10 wherein said means for transmitting power from said driveshaft to said driven shaft comprises a sprocket gear mounted on said drive shaft and a sprocket gear mounted on said driven shaft and there is closed loop means passing around said sprocket gears.

16. A compliant rotary powered tool as recited in claim 10 wherein said power tool is immersed in a fluid medium.

17. A compliant rotary powered tool as recited in claim 10 further comprising a grip for said arm assembly.

18. A compliant rotary powered tool as recited in claim 10 wherein said grip is flexibly attached to the frame member of said rotary powered tool.

19. A compliant rotary tool comprising:

an elongated arm assembly having a forward end and a rearward end;

a driveshaft journaled in the rearward end of said arm assembly so that said arm assembly can pivot around said driveshaft, said driveshaft having a longitudinally extending axis;

a driven shaft journaled in the forward end of said arm assembly, said driven shaft having a longitudinally extending axis;

first drive means rigidly mounted on said driveshaft having a radius $R_1$ as measured from said longitudinal axis of said driveshaft, second drive means rigidly mounted on said driven shaft having a radius $R_2$ as measured from the longitudinal axis of said driven shaft;

closed loop means passing around the radius $R_1$ of said first drive means and around the radius $R_2$ of the second drive means for transmitting the rotational motion of said drive shaft to said driven shaft;

a frame member which is journaled on said driveshaft;

a motor for rotating said driveshaft and it is affixed to said frame member; and means for producing a drag on said driven shaft.

* * * * *